US005662509A

United States Patent [19]

Lieberman

[11] Patent Number: 5,662,509

[45] Date of Patent: Sep. 2, 1997

[54] INFLATABLE NON-WEARABLE FOOTBALL HELMET

[75] Inventor: Marvin S. Lieberman, New York, N.Y.

[73] Assignee: Alvimar Manufacturing Company, Inc., Long Island City, N.Y.

[21] Appl. No.: 552,247

[22] Filed: Nov. 2, 1995

Related U.S. Application Data

[63] Continuation of Ser. No. 197,098, Feb. 16, 1994, abandoned, which is a continuation-in-part of Ser. No. 945, Oct. 29, 1992, abandoned.

[51] Int. Cl.[6] ..... A63H 3/06; A63H 33/00

[52] U.S. Cl. ..... 446/220; 446/27

[58] Field of Search ..... 446/220, 226, 446/26, 27, 325, 326; D21/59, 84, 109

[56] References Cited

U.S. PATENT DOCUMENTS

| | | | |
|---|---|---|---|
| D. 21,874 | 9/1892 | Dixcy | D21/84 |
| D. 80,880 | 4/1930 | Dickman . | |
| D. 238,857 | 2/1976 | Viatte | D29/107 X |
| D. 278,381 | 4/1985 | Saari | 446/220 X |
| D. 289,598 | 5/1987 | Parmet . | |
| D. 315,749 | 3/1991 | Visco et al. | D21/84 |
| D. 318,747 | 7/1991 | Barker . | |
| D. 338,546 | 8/1993 | Barker . | |
| 600,778 | 3/1898 | Frazier . | |
| 780,899 | 1/1905 | Mogridge . | |
| 2,121,702 | 6/1938 | Larkin . | |
| 2,150,290 | 3/1939 | Mulvey . | |
| 2,594,478 | 4/1952 | Moore . | |
| 2,759,186 | 8/1956 | Dye . | |
| 3,186,004 | 6/1965 | Carlini . | |
| 3,555,561 | 1/1971 | Neis | D29/15 X |
| 3,664,401 | 5/1972 | Trovati | 446/220 X |
| 3,801,403 | 4/1974 | Lucek | 446/220 X |
| 3,866,243 | 2/1975 | Morgan . | |
| 4,015,111 | 3/1977 | Spector | 446/220 X |
| 4,124,904 | 11/1978 | Matthes . | |
| 4,324,005 | 4/1982 | Willis . | |
| 4,547,919 | 10/1985 | Wang . | |
| 5,014,366 | 5/1991 | Discipio, Sr. . | |

FOREIGN PATENT DOCUMENTS

| | | | |
|---|---|---|---|
| 815917 | 10/1951 | Germany | 446/220 |
| 941546 | 11/1963 | United Kingdom | 446/226 |

OTHER PUBLICATIONS

One sheet of two photos showing professional football helmets. Photos taken Oct. 7, 1993.

*Primary Examiner*—Robert A. Hafer
*Assistant Examiner*—D. Neal Muir
*Attorney, Agent, or Firm*—Rosen, Dainow & Jacobs, L.L.P.

[57] ABSTRACT

A toy formed as an inflatable football helmet which cannot be put on a person's head has first, second and third parts which are respectively an outer shell formed generally as a helmet with top, front and rear parts, a bottom closure part generally opposite said top part of the helmet, and a face mask overlying said front part of the helmet, these parts all formed of flexible, thin plastic sheet material, said first and second parts defining a first enclosed space, said third part formed a grid of tubes whose bores communicate with each other and define a second enclosed space, said first and second enclosed spaces communicating with each other.

2 Claims, 3 Drawing Sheets

FIG. 7
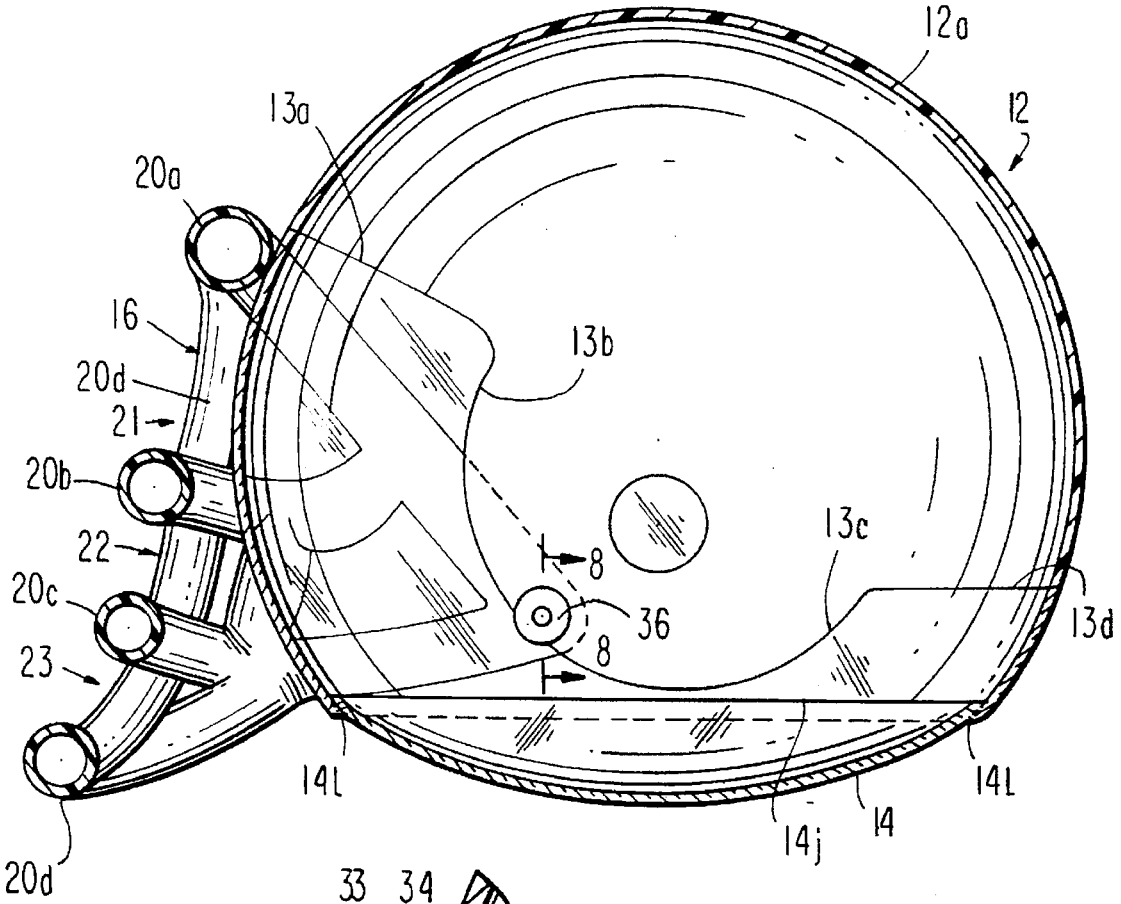
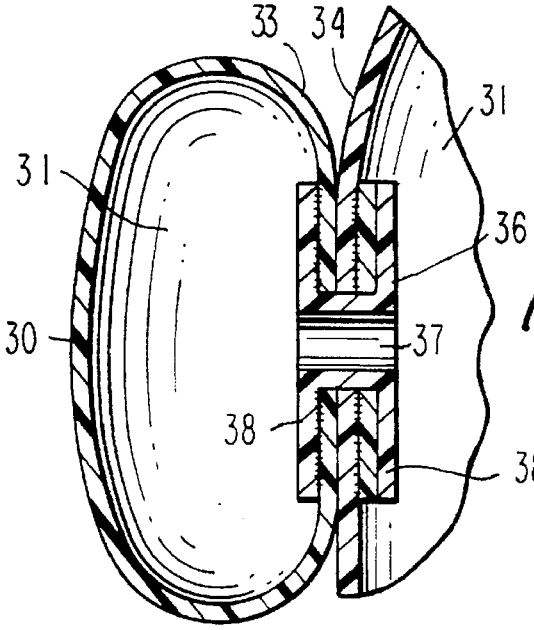
FIG. 8

INFLATABLE NON-WEARABLE FOOTBALL HELMET

This application is a continuation of application No. 08/197,098 filed Feb. 16, 1994 now abandoned, which is a continuation-in-part of 29/000,945, Oct. 29, 1992.

BACKGROUND

This invention is in the field of inflatable toys and promotional and point of sale displays, and particularly inflatable articles such as helmets which are likely to be put on a person's head.

An objective of this invention is to provide an inexpensive inflatable article which represents and simulates a real football helmet and yet is safe from the event of a user putting the helmet on his head and somehow covering his nose and or mouth.

One prior art publication and disclosure of an article that typifies the problem addressed in this application is U.S. Pat. No. Des. 318,747 to Barker and Barker's companion U.S. Pat. Des. No. 338,546. Here an inflatable helmet and face mask is provided comprised of outer and inner shells formed together with an inflatable airspace between the shell layers. This article simulates a real helmet and can be put onto a person's head. If tipped excessively forward or put on backward, a portion of the inner shell could cover the person's nose and mouth and cause suffocation.

In addition to being dangerous as described above these Barker articles appear to require many component parts and complicated assembly which would lead to costly manufacture. Toy or promotional articles like these have a very low sale price, and thus they must be manufacturable in high volume and low cost or there can be no successful commercialization.

Another prior art publication is U.S. Pat. No. 5,129,107 to Lorenzo which is an inflatable helmet intended to be worn by a motorcyclist. This disclosure also typifies the two above-described disadvantages of the prior art and fails to consider or provide the objectives of the present invention, namely to provide a helmet that is safe and inexpensive but very realistic in appearance.

A third prior art disclosure is a typical National Football League football helmet which is constructed of a rigid outer shell, a cushioned interior and an open bottom to receive the user's head.

SUMMARY OF THE INVENTION

This invention achieves the combined objectives of an inflatable helmet that is safe from suffocation by the user, is simple and economic to mass produce, and is attractive and representative of a real football helmet. Instead of the usual outer and inner shells or layers with a structural layer or a layer of air captured between the shells, the new invention provides an outer shell only having a helmet shape and optional indicia thereon, an inflatable face mask at the front of the helmet, and a bottom closure sheet sealing the cavity or airspace within the helmet. The helmet airspace and the inflatable face mask air space are contiguous, so that a single introduction of air or other gas or liquid will inflate both the helmet and the face mask. The helmet is thus an inflatable envelope that is generally, spherical or oval or head shaped with a face mask formed as a grid of interconnected tubes, the spaces between the tubes defining at least one and preferably numerous windows for a theoretical user to have good vision therethrough. The airspace within the tubes forming the mask is preferably contiguous with the helmet airspace, but the spaces could be separate with separate valves for inflation of the helmet and the mask.

Because the bottom of the helmet is sealed by the closure sheet, first there is no possibility of danger to a person trying to put on the helmet, and second the article can be manufactured far less expensively than prior art products, as there is no need to produce an inside or inner shell structure. In this new article the bottom closure sheet may be a generally flat or slightly convex panel when inflated.

A preferred embodiment of this invention will now be described with reference to the appended drawings.

BRIEF DESCRIPTION OF THE DRAWINGS

FIG. 7 is a cross-sectional view taken along line 7—7 in FIG. 1; and FIG. 8 is a sectional view taken along line 8—8 of FIG. 7.

DETAILED DESCRIPTION OF THE PREFERRED EMBODIMENT

Figure 2:
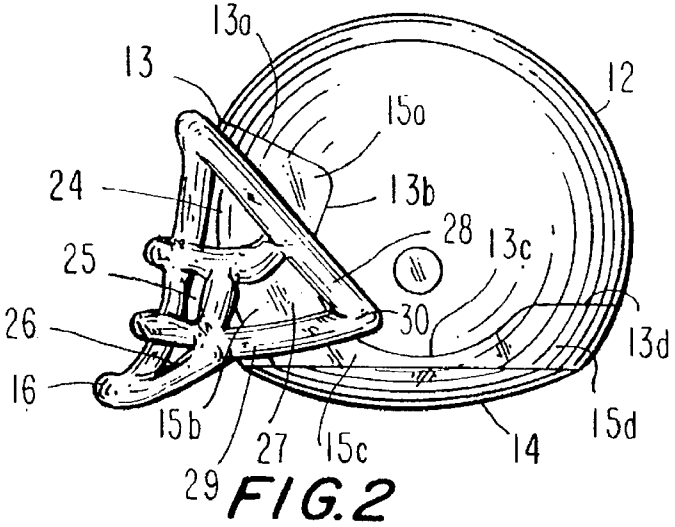
FIG. 2 is a right side elevation thereof.
Figure 3:
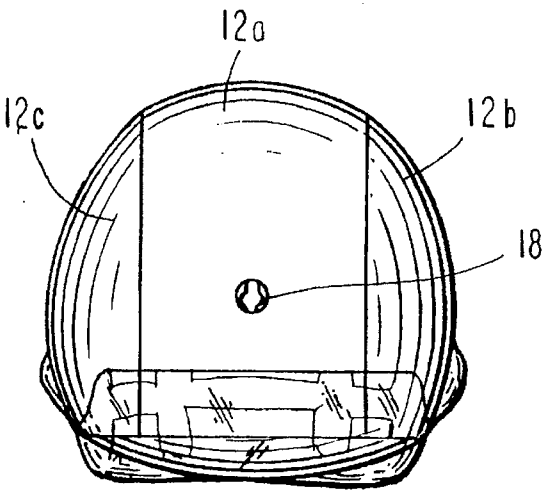
FIG. 3 is rear elevation thereof.
Figure 1:
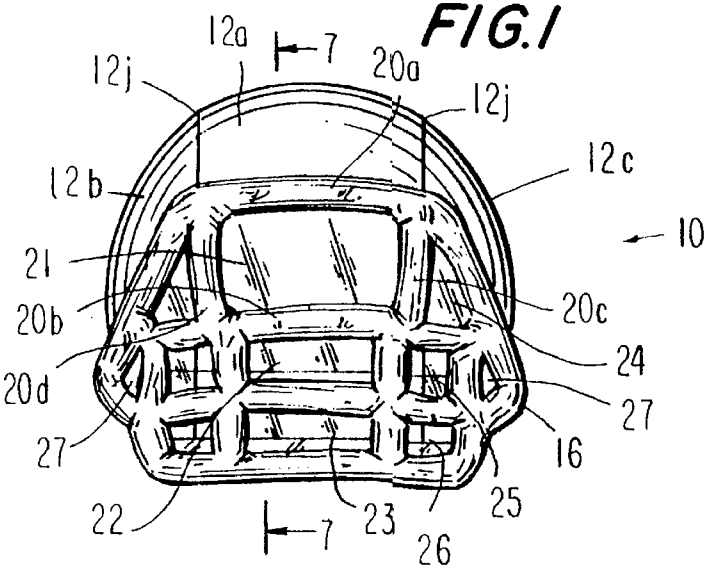
FIG. 1 is a front elevation view of the new helmet.
Figure 5:
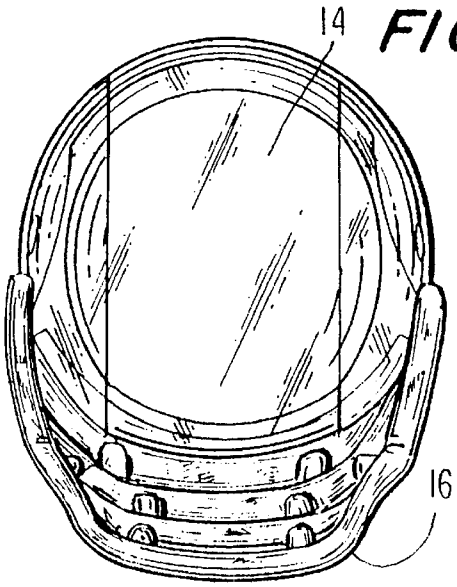
FIG. 5 is a bottom plan view thereof.
Figure 6:
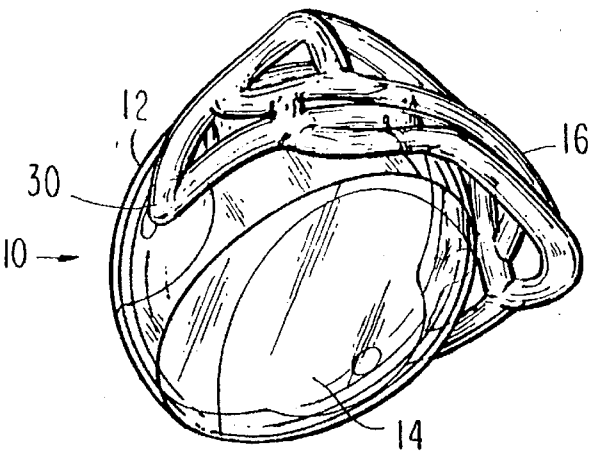
FIG. 6 is a bottom perspective view thereof.
Figure 4:
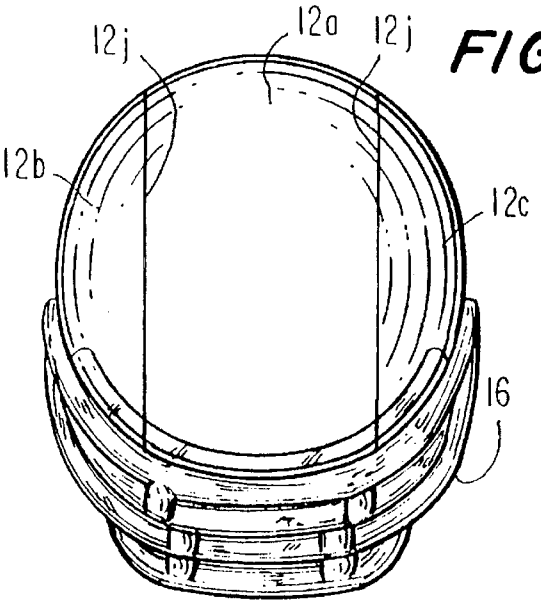
FIG. 4 is a top plan view thereof.

The new helmet 10 is shown in FIGS. 1–6 with sectional FIGS. 7 and 8 added to show further clarification of the internal structure. As shown in FIGS. 1, 2 and 7 there is an outer shell 12, a bottom closure part 14 and a front face mask 16. The outer shell 12 may be made of a single piece of thin flexible plastic sheet or it may be made of separate parts or panels as shown in FIGS. 1, 3 and 4 where there is a central piece 12A and side pieces 12B and 12C. These panels would be sealed along junction line 12J together by typical heat or ultrasonic sealing or other common technique.

In FIG. 2, the line 13, composed of segments 13A, 13B, 13C and 13D, represents the bottom edge of a real helmet. This line 13 thus separates the representation of a real helmet above the line; below the line would be airspace represented by transparent panel portions 15A, 15B, 15C and 15D defining the front of the helmet along with transparent bottom closure part 14. Thus, the helmet element is composed of a curved sheet having a top part and right and left sides extending downward from the top and a rear part extending downward from the top this shell defining a generally smooth continuous curved surface. This top part or helmet portion defines when inflated a shell having an open bottom. The bottom as mentioned above is closed by closure part 14 which is sealed around its periphery to the opening of the helmet shell, the sealing done by typical heat sealing technique.

At the rear of this helmet article is valve 18 which is typical for inflatable objects. Such valves easily receive an introduction of air or other gas and are able to hold such gas within the airspace until released.

Also shown in FIG. 7 is junction line 14J where bottom closure part 14 is sealed at the bottom peripheral edges of the helmet 12. In FIG. 7 reference 14L indicates a narrow edge overlap where helmet material 12 overlies the upper edge of bottom closure member 14, the two being sealed together.

This article being composed of the upper helmet part 12, and the bottom closure part 14 has the third principal component, the face mask 16 forward of the helmets front portions 15A–D. This mask is made of the same thin flexible plastic as the helmet but formed into the grid shown best in FIGS. 1, 2 and 7 of generally horizontal and vertical elements. These elements are each hollow tubes whose bores form a contiguous second airspace, as compared to the first airspace within the helmet hollow. In the face mask horizontal tube elements 20A and 20B and vertical tube elements 20C and 20D define a wide centrally located horizontal window 21 which represents the window for a football player to see through if this were a real helmet. Below window 21 are two smaller horizontally oriented rectangular windows 22 and 23; to the left and right on either side of these three central windows are smaller windows 24, 25 and 26; and finally there is a rearward window 27 at the rear most portion of the mask on each side.

As seen in FIG. 2 window 27 of the face mask is bounded by a downward extending tubular element 28 and a generally horizontal tubular element 29 which tubes come together in junction area 30. As mentioned before, all of the tubes of the face mask grid have contiguous sealant bores such that when inflation occurs, the entire face mask will be inflated. The airspace within the helmet (first airspace in this embodiment) communicates with the airspace within the face mask (second airspace) as shown more clearly in FIGS. 7 and 8, where reference number 31 represents the airspace within the helmet and reference 32 represents the airspace within the face mask. Mask junction portion 30 shown in FIG. 2 is shown enlarged and in section in FIG. 8 where inner wall 33 of the mask overlies wall portion 34 of the helmet. These two surfaces 33 and 34 are joined together either by direct heat sealing or as shown in FIG. 8 by use of a hollow rivet 36 whose bore 37 allows air communication between airspace 31 and 32. The flanges 38 of the rivet on each end thereof engage and seal to the plastic material of the face mask and the helmet.

The face mask 16 as shown in FIG. 7 is composed of a series of tubes as shown. These tubes may be made as individual tubes by any common technique, including extruding or by using strips of plastic which are sealed longitudinally along an edge and thus formed into tubes, or the entire grid of the face mask may be formed of a pair of mating sheets which are joined together in a sealing operation which creates all the tubes generally at the same time.

The sheet material used for this article could be selected from a variety of soft, thin, flexible thermoplastic sheet materials that are substantially air impermeable and preferably thermoplastic, such as polyvinylchlorides, polyolefins and polyesters having thickness in the range of about 0.20 mm to 0.40 mm. The article shown being a helmet can have colors and indicia incorporated in the material prior to assembly so as to better simulate a professional football helmet, such indicia including selected colors, patterns and symbols as represents the actual teams.

As shown in these figures and as described herein, an article is provided which can serve as a toy or as an ornamental or promotional article. It can be made in any of a vast range of sizes and can be used for both childrens' and adults' toys, gifts and collectors' items, and for commercial purposes as displays and point of sale promotional items.

This invention may take a variety of other forms still within the scope of the invention and the claims appended hereto. For example, helmets of various other shapes are possible so long as the bottom serves both to close the airspace within the helmet and serves to prevent anyone from putting the helmet on his head and engaging in a potentially dangerous activity. Thus, the invention applies to any form of hat or head covering or any inflatable object which would be attractive to children and/or adults and could conceivably be put onto the head and cover the nose and mouth creating the above-described danger.

I claim:

1. A toy formed as an inflatable football helmet which cannot be put on a person's head, comprising: a substantially air-impermeable shell inflatable to a generally spherical shape formed of a single layer of thin flexible plastic sheet material, said shell including front, rear, top, bottom, left and right parts which define a first enclosed space, and a face mask fixed to said shell and situated forward of said front part of said shell, said front and bottom parts being generally transparent and said remaining parts are opaque, said face mask formed of thin flexible air-impermeable plastic sheet material and defining a second space that is inflatable and communicates with said first space, said face mask having at least one opening there through generally adjacent said transparent front part of said helmet, whereby the front part of the said helmet is visible through said at least one opening in said face mask, and valve means for allowing introduction of and retaining therein a fluid in said first and second spaces for inflating same, wherein said generally spherical shape defines a first radius of curvature, and wherein said bottom part of said shell has a second radius of curvature much greater than said first radius of curvature.

2. A toy formed as an inflatable football helmet which cannot be put on a person's head, the toy being inflatable by a fluid introduced therein, the toy comprising first, second and third parts which are respectively an outer shell formed generally as a helmet with top, front and rear parts, a bottom closure part generally opposite said top part of the helmet, and a face mask fixed to said shell and situated forward of the front part of the helmet, these parts all formed of flexible, thin plastic sheet material, said first and second parts defining a first enclosed space, said face mask defining a second enclosed space, said first and second enclosed spaces communicating with each other, said toy further comprising valve means for allowing introduction of and retaining therein a fluid in said first and second spaces for inflating same, wherein said helmet is generally spherical from the top extending downward toward the front, rear and sides, said generally spherical shape defining a first radius of curvature, and said bottom closure has a much greater radius of curvature.

* * * * *